United States Patent [19]

Sumerau et al.

[11] Patent Number: 4,662,026

[45] Date of Patent: May 5, 1987

[54] CONVERTIBLE VACUUM CLEANER HANDLE

[75] Inventors: William R. Sumerau, Easley; Valerie D. Owens, Townville, both of S.C.

[73] Assignee: The Singer Company, Stamford, Conn.

[21] Appl. No.: 863,498

[22] Filed: May 15, 1986

[51] Int. Cl.[4] ..... A47L 9/32

[52] U.S. Cl. ..... 15/329; 15/144 B; 15/344; 15/410

[58] Field of Search ..... 15/329, 410, 144 B, 15/344

[56] References Cited

U.S. PATENT DOCUMENTS

| | | | |
|---|---|---|---|
| 1,558,006 | 10/1925 | Fisker | 15/344 |
| 2,819,485 | 1/1958 | Sparklin | 15/410 X |
| 3,204,272 | 9/1965 | Greene et al. | 15/410 X |
| 3,758,914 | 9/1973 | Nupp et al. | 15/329 |

FOREIGN PATENT DOCUMENTS

| | | | |
|---|---|---|---|
| 398849 | 7/1924 | Fed. Rep. of Germany | 15/410 |
| 3114303 | 11/1982 | Fed. Rep. of Germany | 15/410 |
| 3435878 | 4/1986 | Fed. Rep. of Germany | 15/410 |
| 1066808 | 1/1954 | France | 15/410 |

*Primary Examiner*—Chris K. Moore

*Attorney, Agent, or Firm*—David L. Davis

[57] ABSTRACT

A vacuum cleaner handle shiftably supported on a vacuum cleaner body for selective positioning thereon suiting floor supported or hand carried vacuum cleaner operation and including handle segments telescopically adjustable and secured by a common latch element into different handle lengths each suitable for a different vacuum cleaner operating mode.

6 Claims, 6 Drawing Figures

Fig. 2.
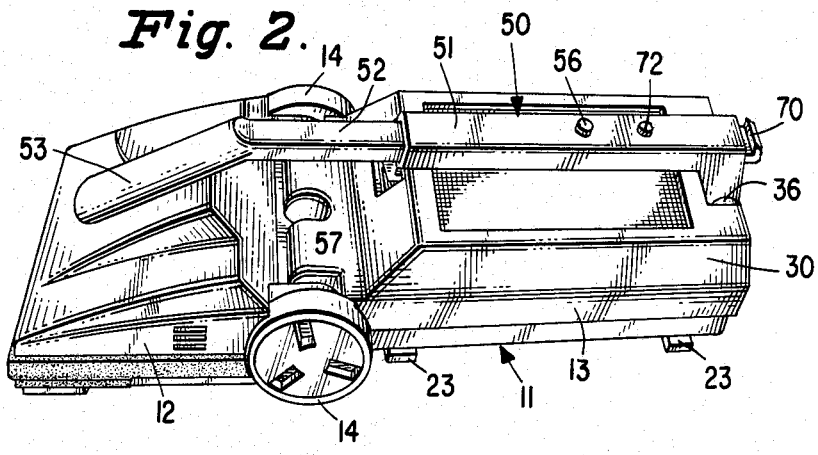
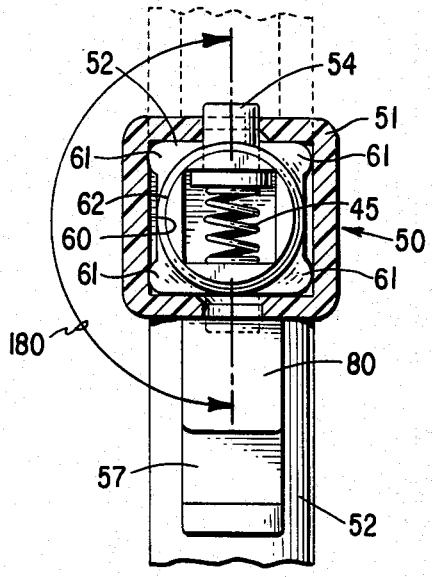
Fig. 6.
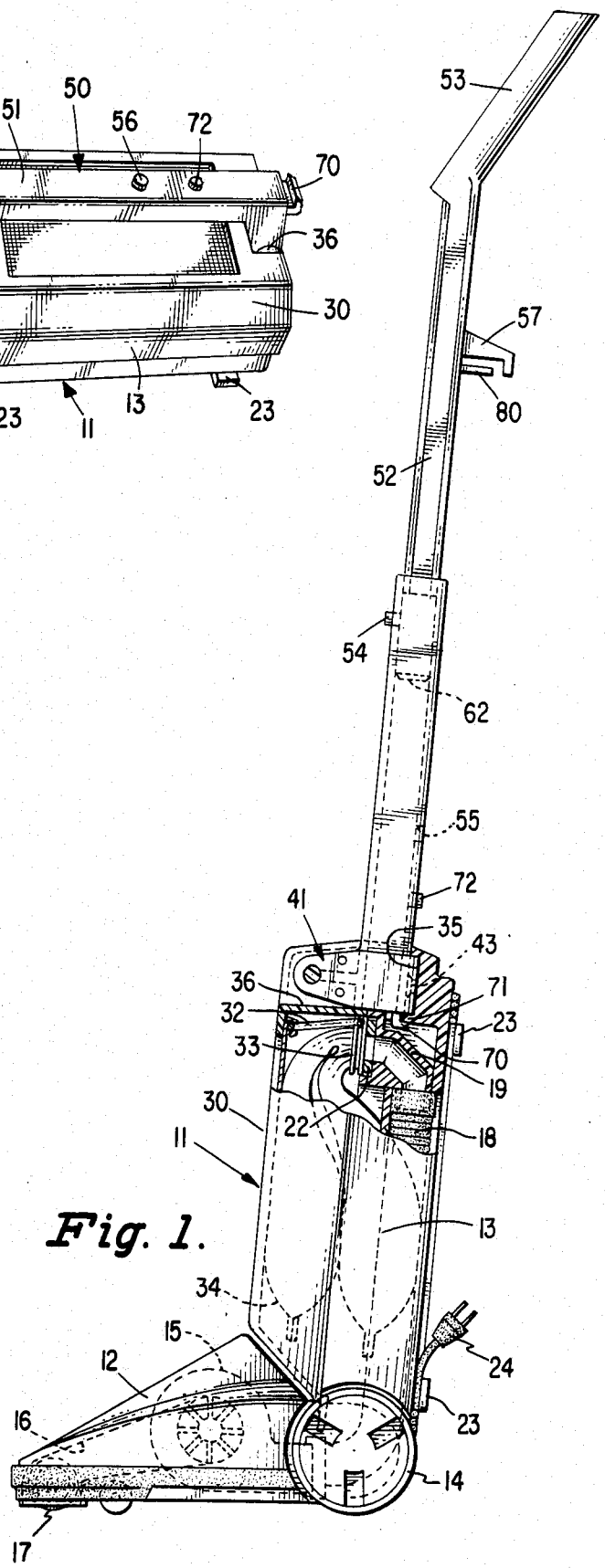
Fig. 1.

CONVERTIBLE VACUUM CLEANER HANDLE

BACKGROUND OF THE INVENTION

1. Field of the Invention

This invention relates to vacuum cleaners or similar appliances adapted to be utilized in either a floor supported or hand carried mode and, more particularly, to a handle construction which is convertible quickly and easily to accommodate selectively floor supported or hand carried modes of appliance operation without imposing serious limitation on the size or shape of the vacuum cleaner or like appliance to which the handle is applied.

2. Description of the Prior Art

U.S. Pat. No. 1,558,006 of Fisker, Oct. 20, 1925, and U.S. Pat. No. 3,758,914 of Nupp et al, Sept. 18, 1973, each discloses an elongate handle pivoted to a vacuum cleaner with means for securing the handle in either an extended position for floor supported use of the cleaner or a retracted position along the cleaner for a hand carried mode of cleaner use. In each of these patent disclosures, the length of the handle adequate for floor supported use of the appliance dictates an awkward, abnormally long length of cleaner body for handle accommodation in the hand carried mode.

U.S. Pat. No. 3,203,707 of Anderson, Aug. 31, 1965, discloses a convertible handle for an appliance which handle includes pivotally interconnected segments which, in a hand carried mode, provide a cumbersome array of folded handle parts over the appliance body restricting access to the appliance and limiting proximity to which the appliance may be moved relatively to furniture, fixtures, and the like.

SUMMARY OF THE INVENTION

It is an object of this invention to provide a convertible handle for a vacuum cleaner or similar appliance, which handle has articulated segments which may be selectively interlocked in different angular as well as telescopic relationships so that the combined length and disposition of handle parts may differ widely in the different modes of appliance use and not dictate the size or shape of appliance body.

It is also an object of this invention to provide a novel and cost effective system of interlocks and latches for securing the handle of this invention selectively in various different relative positions of parts and in various different relationships to a vacuum cleaner or similar appliance body.

DESCRIPTION OF THE DRAWINGS

The above and additional objects and advantages of this invention will be apparent from the following description taken in conjunction with the accompanying drawings of a preferred embodiment in which:

FIG. 1 is a side elevational view partly in cross section of a vacuum cleaner having a handle in accordance with this invention applied thereto and arranged in a position suitable for floor supported operation of the vacuum cleaner;

FIG. 2 is a front perspective view of the vacuum cleaner of FIG. 1 showing the handle arranged in a position suitable for hand carried vacuum cleaner operation;

FIG. 6 is a cross sectional view transversely of the handle taken substantially along line 6—6 of FIG. 3.

DESCRIPTION OF THE PREFERRED EMBODIMENT

Figure 3:
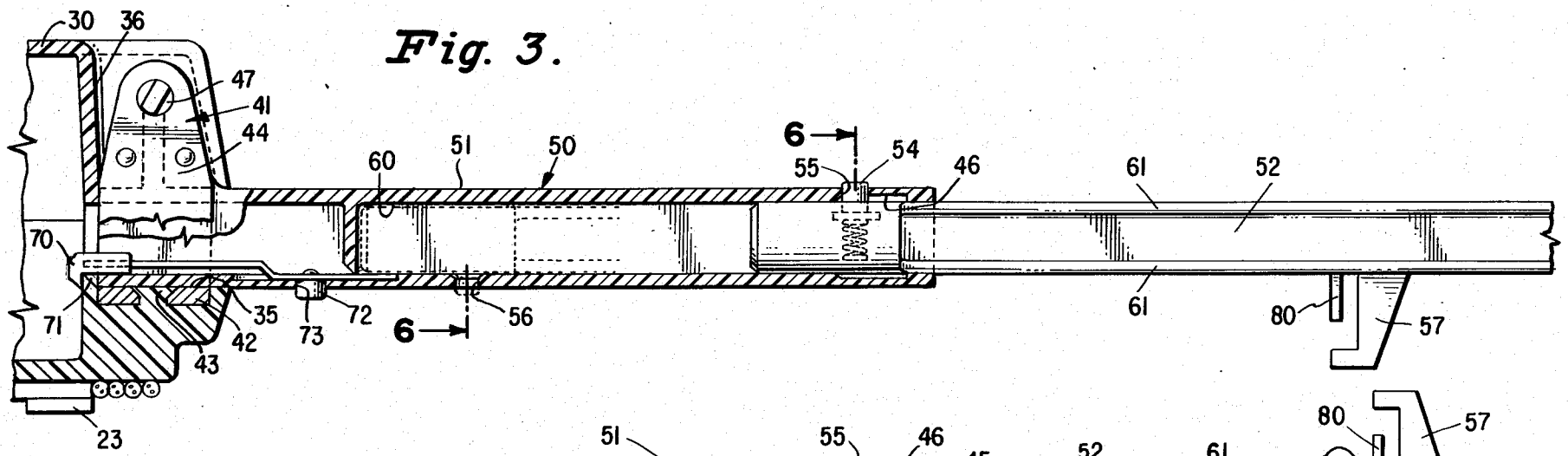
FIG. 3 is an enlarged elevational view of the handle of this invention with the parts shown interlocked in the extended position suitable for floor supported vacuum cleaner operation and with portions of the handle segments broken away and illustrated in cross section.
Figure 4:
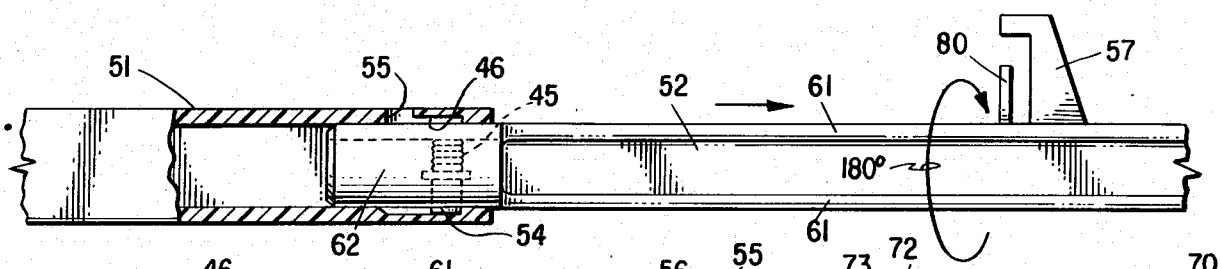
FIG. 4 is an enlarged elevational view of the handle similar to that of FIG. 3, but with the interlocks between parts released and the parts shifted to extreme extended relation suitable for accommodating relative rotation.

Referring particularly to FIG. 1 of the drawings, this invention is illustrated as applied to a vacuum cleaner indicated generally at 11 and comprising a housing including a head portion 12 pivotally connected to a body portion 13. Wheels 14 may be rotationally supported on or adjacent the pivotal connection between the head and body portions. A motor blower 15 is aranged in the head portion together with a nozzle 16 which may be fitted with a driven brush 17. A flexible tube 18 extends from the motor blower 15 in the head portion 12 along a trough 19 formed in the rear of the body portion 13 and provides a conduit to an exhaust fitting 19 providing a terminus to the air conduit from the vacuum cleaner nozzle 16. The exhaust fitting is preferably fitted with flexible gasket 22. Retaining fingers 23 extending from the rear of the vacuum cleaner body portion 13 provide storage for coils of the power cord 24 for the motor blower.

The body portion 13 of the vacuum cleaner housing is adapted to be closed by a cover 30 having the form of a shallow tray. The tray-like cover 30 is provided with a bent wire dirt bag retainer 32 shaped so as to embrace and locate a collar portion 33 of a disposable dirt collecting bag 34 in registry with the exhaust fitting 20 in effective position to separate and collect dirt from air delivered into the bag from the conduit.

Figure 5:
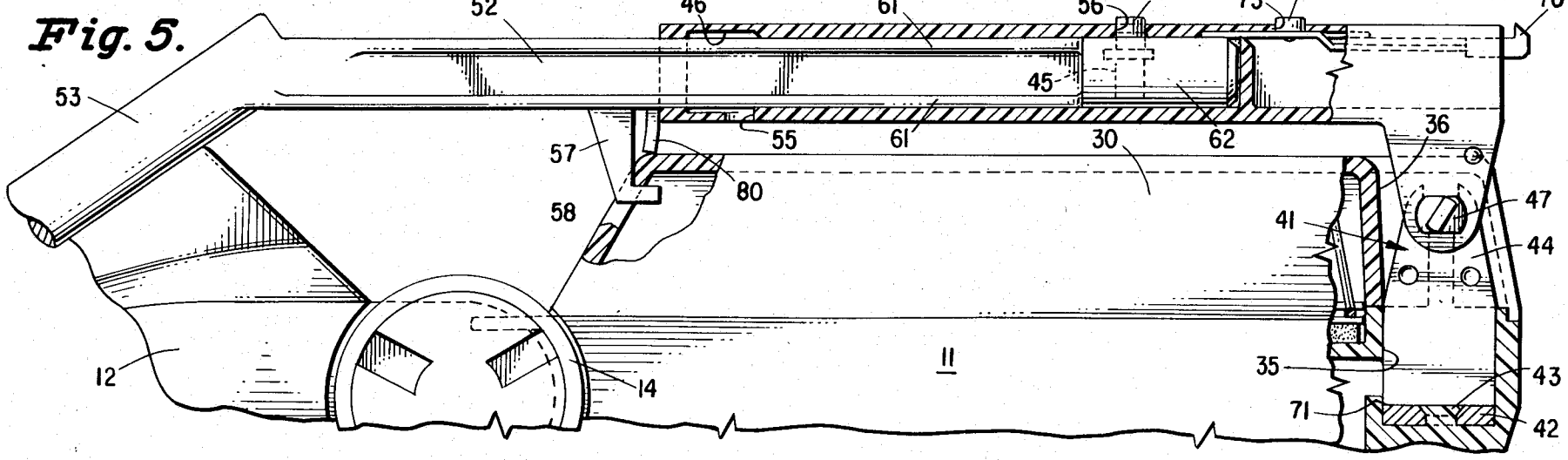
FIG. 5 is an enlarged elevational view of the handle similar to that of FIG. 3, but with the parts shown interlocked in retracted position suitable for hand carried vacuum cleaner operation.

The free extremity of the cleaner body portion 13 and the cover 30 are formed with aligned recesses 35 and 36, respectively, adapted to accommodate means for supporting a handle indicated generally at 50 on the vacuum cleaner. Preferably, the handle is supported on the cleaner body by a U-shaped bracket 41 which, as best shown in FIGS. 3 and 5, has a base 42 secured to the cleaner body by an suitable means, such as a staking 43, or use of a rivet or other fastening device. The bracket 41 is formed with a pair of bracket arms 44 in which bearing projections 47 formed on the handle 50 are journaled.

The handle 50 may be pivoted relatively to the vacuum cleaner housing selectively into either of two positions, each suitable for a different mode of vacuum cleaner operation. FIGS. 1 and 3 illustrate the extended position of the handle relatively to the cleaner housing suiting the cleaner for upright floor supported vacuum cleaning operation, while FIGS. 2 and 5 illustrate the retracted position of the handle suitable for hand carried vacuum cleaning operation. The preferred construction of the handle 50 and the means for accommodating the handle in three different positions without appreciable limitation on the size and configuration of the vacuum cleaner housing will now be described.

Preferably, the handle 50 is formed with two telescopically and rotationally interrelated parts 51 and 52, part 51 being that formed with the bearing projections 47. The part 52, which is formed at one extremity with a hand grip 53, is slidable lengthwise within the handle part 51 and at the extremity opposite the hand grip carries a latch button 54 loaded by a spring 45, which latch button is engageable with a latch aperture 55 near the free extremity of the handle portion 51 to lock the handle parts in extended position, or with a latch aperture 56 near the pivoted extremity of the handle portion 51 to lock the handle parts in retracted position depending upon the relative rotational position of the handle parts. In the retracted postion of the handle parts, as shown in FIG. 5, a projection 57 on handle part 52 seats in a socket 58 in the cover 30 to constrain the handle in position for supporting the cleaner in a hand carried vacuum cleaning operation.

In order to accommodate movement of the handle part 52 telescopically within the handle part 51, the handle part 51 is formed as shown in FIG. 6 with a hollow interior 60 which is rectangularly shaped. A major portion of the exterior of the handle part 52 is formed with rounded extensions 61 at each corner together defining a rectangular overall cross sectional configuration of the handle part 52 which is telescopically receivable within the hollow interior 60 of handle part 51 in two diametrically opposed positions of rotation of the handle part 52 relative to handle part 51.

The extremity of the handle part 52 opposite the hand grip 53 is formed with a cylindrical cross sectional shape 62 to accommodate such rotational movement of the handle parts when the latch button 54 is depressed into the aperture 55. When so depressed, the latch buton 54 may be accommodated in an undercut 46 in the hollow interior 60 to prevent complete separation of the handle parts 51 and 52.

FIGS. 1 and 3 illustrate a latch device effective to constrain the handle in the extended position relatively to the cleaner housing rendering the cleaner suitable for upright floor supported vacuum cleaning operation. This latch device comprises a flexible latch element 70 secured inside the handle portion 51 and arranged protruding from the handle, as illustrated in FIGS. 1 and 3, to engage beneath a shoulder 71 on the cleaner body portion 13 to retain the handle in the position shown in FIGS. 1 and 3. A release button 72 carried by the latch element 70 within the handle portion 51 is accessible to an operator through an aperture 73 in the handle permitting the latch element 70 to be shifted out of engagement beneath the shoulder 71 freeing the handle for pivotal movement out of the extended position.

FIG. 5 best illustrates the latch device effective to constrain the handle in the retracted position relatively to the cleaner housing rendering the cleaner suitable for hand carried vacuum cleaning operation in the form illustrated in FIG. 2.

As described above, and with particular reference to FIG. 5, when the handle part 52 is rotated 180° from the position relative to the handle part 51 shown in FIGS. 1 and 3 and the handle 50 is rotated about the bearing projections 47 into retracted position adjacent the cleaner housing, the handle part 52, upon telescopic insertion into handle part 51, shifts a projection 57 on handle part 52 into a cover socket 58 substantially simultaneously with the reception of the latch button 55 into the aperture 56 in the handle part 51. To remove any looseness in the interlocking relation between the handle and the cleaner housing, a resilient tab 80 is formed to extend from the handle part 52 adjacent to the projection 57. The tab 80 engages the cover 30 in the interlocked position of the projection within the socket 58 and, in being deflected thereby, the resilient tab 80 imposes a light force between the handle 50 and the cleaner housing to remove any slack therebetween.

What is claimed is:

1. A vacuum cleaner having a housing;

means associated with said body portion defining an air conduit, means in said body portion for inducing flow of air through said conduit, and means for separating and collecting dirt entrained in said air flowing through said conduit;

a handle;

means pivotally securing said handle to said vacuum cleaner housing for movement selectively to a first position extending from said vacuum cleaner body portion for floor supported vacuum cleaning or to a second position adjacent to said vacuum cleaner housing for portable hand caried vacuum cleaner operation;

said handle comprising at least two telescopically arranged sections; and operator influenced latch means effective to lock said handle sections in different degrees of telescoped relation whereby the overall length of the handle may be varied significantly when moved from one to the other of said positions.

2. A vacuum cleaner as set forth in claim 1 in which the cross sectional shape of the telescopically arranged handle sections are generally rectangular so as to provide only two alternative relative positions of rotation of the handle sections in which telescopic interrelation is permissible.

3. A vacuum cleaner as set forth in claim 1 in which separate interlock means are provided between said handle and said vacuum cleaner housing for securing said handle in a selected one of said first or second positions on said cleaner body.

4. A vacuum cleaner as set forth in claim 3 in which said means pivotally supporting said handle is associated with one section of said telescopically arranged handle sections, and in which said latch means is provided by said one handle section being formed on diametrically opposite sides with latch engaging apertures, each of said apertures being spaced a different distance from said pivotal supporting means;

said other handle section being telescopically and rotatably shiftable with respect to said one handle section; and a single operator influenced latch projection carried by said other handle section for interlocking engagement with a selected one of said latch engaging apertures depending upon the position of rotation of said other handle section.

5. A vacuum cleaner as set forth in claim 4 in which said interlock between said handle and said cleaner body in the second position of said handle is provided by a mating projection and socket formed one on said other handle section and the other on said cleaner body; said projection and socket being positioned for interengagement upon telescopic insertion of said other handle section into said one handle section and for maintenance in said interlocked relation by said latch means between said handle sections.

6. A vacuum cleaner as set forth in claim 5 in which said interlock between said handle and said cleaner body in the first position of said handle is influenced by a latch means independent from said latch means between said handle sections.

* * * * *